United States Patent [19]

Ishiguro et al.

[11] Patent Number: 4,873,172

[45] Date of Patent: Oct. 10, 1989

[54] PROCESS FOR FORMING A SUPERHIGH CONTRAST NEGATIVE IMAGE

[75] Inventors: Shoji Ishiguro; Shigeo Hirano; Tadao Shishido, all of Kanagawa; Akio Miyake, Osaka, all of Japan

[73] Assignee: Fuji Photo Film Co., Ltd., Kanagawa, Japan

[21] Appl. No.: 229,796

[22] Filed: Aug. 8, 1988

Related U.S. Application Data

[63] Continuation of Ser. No. 857,270, Apr. 30, 1986, abandoned.

[30] Foreign Application Priority Data

Apr. 30, 1985 [JP] Japan ..... 60-93324

[51] Int. Cl.[4] ..... G03C 1/06

[52] U.S. Cl. ..... 430/264; 430/267; 430/445; 430/446; 430/448; 430/598; 430/614; 430/615

[58] Field of Search ..... 430/264, 267, 445, 446, 430/448, 598, 614, 615

[56] References Cited

U.S. PATENT DOCUMENTS

| | | | |
|---|---|---|---|
| 4,108,662 | 8/1978 | Hayashi et al. | 430/267 |
| 4,269,929 | 5/1981 | Nothnagle | 430/267 |
| 4,311,781 | 1/1982 | Mifune et al. | 430/439 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A process for forming a superhigh contrast negative image with a stable developer is disclosed, which comprises development processing a silver halide photographic material in the presence of a compound of formula (I) and a compound of formula (II) as defined in the specification.

15 Claims, No Drawings

PROCESS FOR FORMING A SUPERHIGH CONTRAST NEGATIVE IMAGE

This is a continuation of application Ser. No. 06/857,270, filed Apr. 30, 1986, now abandoned.

FIELD OF THE INVENTION

This invention relates to a process for forming a superhigh contrast negative image by using a silver halide photographic material. More particularly, it relates to a process for forming a superhigh contrast negative image by using a silver halide photographic material which is useful in photomechanical processes.

BACKGROUND OF THE INVENTION

In photomechanical processes, an image formation system providing superhigh contrast photographic characteristics, especially, a gamma ($\gamma$) of 10 or more, is required for satisfactory reproduction of continuous tone or line images. For this purpose, a hydroquinone developer (infectious developer) having an extremely low effective concentration of a sulfite ion, usually 0.1 mol/liter or less, has generally been used. However, such a developer is very unstable because of its low sulfite ion concentration and cannot withstand preservation for long periods of time, e.g., exceeding 3 days.

U.S. Pat. No. 2,419,975 discloses that addition of a certain hydrazine compound to a silver halide emulsion provides high contrast negative images, but superhigh contrast negative images having a gamma of 10 or more cannot be obtained with the hydrazine compounds specifically recited in this patent unless a developer having a pH value as high as 12.8 is used. Such a strongly alkaline developer having a pH in the vicinity of 13 is susceptible to air oxidation, and, therefore, cannot withstand long term preservation or use. Although preservability of the developer may be improved by increasing the sulfite ion content, a large amount of a sulfite would be necessary for sufficient improvement in stability of such a high pH developer, which leads to serious problems of not only contamination of a processing solution but hindrance to high contrast of images.

It has, therefore, been keenly desired to provide an image formation system which ensures high contrast of images and satisfactory preservability of a processing solution without being accompanied by the above described disadvantages.

One type of image formation system proposed comprises processing a surface latent image type silver halide photographic material to which a specific acylhydrazine compound that is not disclosed in the aforesaid U.S. Pat. 2,419,975 has been added with a stable developer of pH of from 11.0 to 12.3, to thereby obtain a superhigh contrast negative image, as described in U.S. Pat. Nos. 4,224,401, 4,168,977, 4,166,742, 4,311,781, 4,272,606, 4,221,857, 4,243,739, etc.

However, the above described image formation system involves a problem in that a superhigh contrast image can hardly be obtained when applied to the so-called rapid access processing enjoying an increasing demand, that is, an extremely rapid photographic processing requiring a total processing time of only from 90 to 120 seconds from the start of processing through obtaining a dried film with a time assigned to development being from 15 to 60 seconds.

On the other hand, a contrast silver halide emulsion formed in the presence of a rhodium salt has been proposed in, e.g., British Pat. No. 775,197, U.S. Pat. No. 3,531,289, etc., but the increase of contrast reached by the addition of a rhodium salt is relatively small. For example, Example 1 of U.S. Pat. No. 3,531,289 shows an increase in contrast of only from 2.60 to 3.20. In addition, use of a further increased amount of rhodium results in a reduction of the degree of blackening, i.e., maximum density. Therefore, such a silver halide emulsion fails to provide a superhigh contrast image needed for silver halide photographic materials for photomechanical processes.

SUMMARY OF THE INVENTION

Accordingly, an object of this invention is to provide an image formation process using a silver halide photographic material, which can provide a superhigh contrast negative image having a gamma ($\gamma$) of 10 or more with a stable developer.

Another object of this invention is to provide a rapid image formation process which can rapidly provide a superhigh contrast photographic characteristic having a gamma of 10 or more.

These objects can be accomplished by a process for forming a superhigh contrast negative image comprising development processing a photographic light-sensitive material comprising a support having provided thereon at least one silver halide emulsion layer with a developer containing not less than 0.15 mol/liter of a sulfite ion and having a pH of from 10.5 to 12.3, wherein the development processing is carried out in the presence of a compound represented by formula (I) and a compound represented by formula (II) as described below:

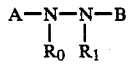

(I)

wherein A represents an aliphatic group or an aromatic group; B represents a formyl group, an acyl group, in alkyl- or arylsulfonyl group, an alkyl- or arylsulfinyl group, a carbamoyl group, a sulfamoyl group, an alkoxy- or aryloxycarbonyl group, a sulfinamoyl group, an alkoxysulfonyl group, a thioacyl group, a thiocarbamoyl group, or a heterocyclic group; $R_0$ and $R_1$ each represents a hydrogen atom, a substituted or unsubstituted alkylsulfonyl group, a substituted or unsubstituted arylsulfonyl group, or a substituted or unsubstituted acyl group, provided that at least one of $R_0$ and $R_1$ is a hydrogen atom; or B, $R_{1'}$, and the nitrogen atom to which B and $R_1$ are bonded jointly form the group

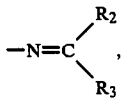

wherein $R_2$ represents an alkyl group, an aryl group, or a heterocyclic group, and $R_3$ represents a hydrogen atom, an alkyl group, an aryl group, or a heterocyclic group;

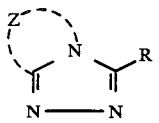

(II)

wherein Z represents an atomic group comprising atoms selected from carbon atoms and nitrogen atoms forming a 5- to 7-membered unsaturated heterocyclic or condensed heterocyclic ring, wherein the unsaturated condensed heterocyclic ring is condensed with a monocyclic or dicyclic aryl group; and R represents a group comprising at least one of hydrogen, carbon, oxygen, nitrogen, sulphur, and halogen atoms.

DETAILED DESCRIPTION OF THE INVENTION

In the above described formula (I), the aliphatic group as represented by A preferably contains from 1 to 30 carbon atoms (including carbon atoms of substituents, if any), and more preferably includes a substituted or unsubstituted straight or branched chain or cyclic alkyl group having from 1 to 20 carbon atoms (including carbon atoms of substituents, if any). The branched chain alkyl group may be cyclized so as to contain a saturated hetero ring containing at least one hetero atom. The substituents for the substituted alkyl group includes an aryl group, an alkoxy group, a sulfoxy group, a sulfonamido group, a carboxyamido group, etc.

Specific examples of the aliphatic group A include a t-butyl group, an n-octyl group, a t-octyl group, a cyclohexyl group, a pyrrolidyl group, an imidazolyl group, a tetrahydrofuryl group, a morpholino group, and the like.

The aromatic group as represented by A is a substituted or unsubstituted monocyclic or dicyclic aryl group or a substituted or unsubstituted heterocyclic group. The unsaturated heterocyclic group may be condensed with a monocyclic or dicyclic aryl group to form a heteroaryl group.

Specific examples of the aromatic group A include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, with those containing a benzene ring being preferred.

Most preferred among these aromatic groups is a substituted or unsubstituted aryl group.

The substituent for the substituted aryl or unsaturated heterocyclic groups typically includes a straight or branched chain or cyclic alkyl group (preferably having from 1 to 20 carbon atoms); an aralkyl group (preferably a monocyclic or dicyclic aralkyl group having from 1 to 3 carbon atoms in its alkyl moiety); an alkoxy group (preferably having from 1 to 20 carbon atoms); a substituted amino group (preferably substituted with an alkyl group having up to 20 carbon atoms, a heteroarylidene group, or an alkylidene group); a sulfonamido group (preferably having from 1 to 30 carbon atoms); 2-thiothiazolidine-2,4-diones; 2-thioimidazolidine-2,5-diones; a group represented by

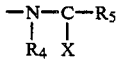

wherein X represents an oxygen atoms or a sulfur atom, $R_4$ represents a hydrogen atom or an alkyl group, and $R_5$ represents a substituted or unsubstituted alkyl, aryl, alkylthio, arylthio, alkylamino, or arylamino group, which has up to 20 carbon atoms; and the like.

The group A may have incorporated therein a ballast group that is commonly employed in immobile photographic additives, such as couplers. A ballast group is relatively inert to photographic properties and contains 8 or more carbon atoms and can be selected from, for example, an alkyl group, an alkoxy group, a phenyl group, an alkylphenyl group, a phenoxy group, an alkylphenoxy group, and the like.

The group A may also have incorporated therein a group which enhances adsorption to the surface of the silver halide grains. Examples of such adsorptive groups include those described in U.S. Pat. Nos. 4,385,108 and 4,459,347, Japanese patent application (OPI) Nos. 195233/84, 200231/84, 201045/84, 201046/84, 201047/84, 201048/84 and 201049/84 (the term "OPI" as used herein refers to a "published unexamined Japanese patent application"), Japanese patent application Nos. 36788/84, 11459/85, 19739/85, etc., such as a thiourea group, a heterocyclic thioamido group, a mercapto heterocyclic group, a triazole group, etc.

In formula (I), B represents a formyl group, an acyl group (e.g., an acetyl group, a propionyl group, a methoxyacetyl group, a dialkylaminoacetyl group, a trifluoroacetyl group, a chloroacetyl group, a benzoyl group, a 4-chlorobenzoyl group, a pyruvoyl group, a methoxalyl group, a methyloxamoyl group, etc.), an alkylsulfonyl group (e.g., a methanesulfonyl group, a 2-chloroethanesulfonyl group, etc.), an arylsulfonyl group (e.g., a benzenesulfonyl group, etc.), an alkylsulfinyl group (e.g., a methanesulfinyl group, etc.), an arylsulfinyl group (e.g., a benzenesulfinyl group, etc.), a carbamoyl group (e.g., a methylcarbamoyl group, a phenylcarbamoyl group, etc.), a sulfamoyl group (e.g., a dimethylsulfamoyl group, etc.), an alkoxycarbonyl group (e.g., a methoxycarbonyl group, a methoxyethoxycarbonyl group, etc.), an aryloxycarbonyl group (e.g., a phenoxycarbonyl group, etc.), a sulfinamoyl group (e.g., a methylsulfinamoyl group, etc.), an alkoxysulfonyl group (e.g., a methoxysulfonyl group, an ethoxysulfonyl group, etc.), a thioacyl group (e.g., a methylthiocarbonyl group, etc.), a thiocarbamoyl group (e.g., a methylthiocarbamoyl group, etc.) or a heterocyclic group (e.g., a pyridine ring, etc.).

Of these, preferred are a formyl group, and an acyl group which may be substituted with an electron donative group (Hammett's sigma value $\sigma<0$).

The group B may be taken together with $R_1$ and the nitrogen atom to which B and $R_1$ are bonded to form

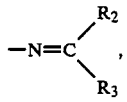

a partial structure of hydrazone, wherein $R_2$ represents an alkyl group, an aryl group, or a heterocyclic group, and $R_3$ represents a hydrogen atom, an alkyl group, an aryl group, or a heterocyclic group.

$R_0$ and $R_1$ each represents a hydrogen atom, an alkylsulfonyl group having up to 20 carbon atoms, an arylsulfonyl group (preferably a phenylsulfonyl group or a substituted phenylsulfonyl group having a total Hammett's sigma value (the total of the individual Hammett's values for each of the substituents) of −0.5 or more), or an acyl group having up to 20 carbon atoms (preferably a benzoyl group, a substituted benzoyl group having a total Hammett's sigma value of −0.5 or more or a substituted or unsubstituted straight or branched chain or cyclic aliphatic acyl group, the substituent including, for example, a halogen atom, an ether group, a sulfonamido group, a carbonamido group, a hydroxyl group, a carboxyl group, a sulfonic acid group, etc.). Of these, most preferred is a hydrogen atom.

Specific but non-limiting examples of the compounds represented by formula (I) are set forth below.

I-1

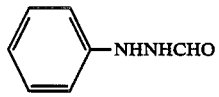

I-2

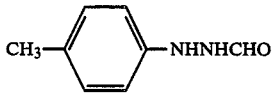

I-3

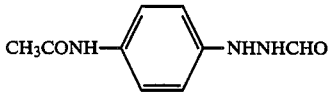

I-4

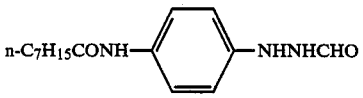

I-5

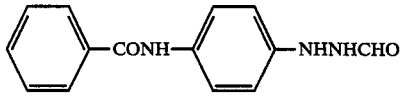

I-6

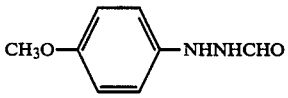

I-7

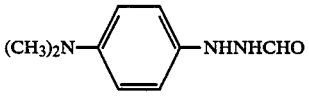

I-8

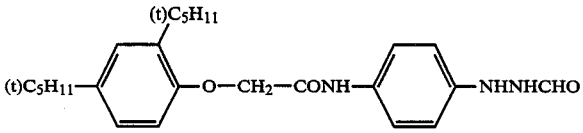

I-9

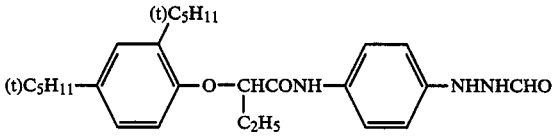

I-10

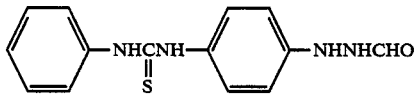

I-11

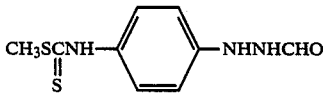

I-12

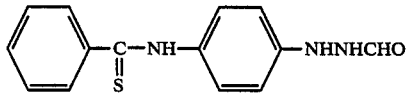

-continued
I-13
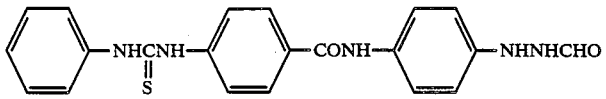
I-14
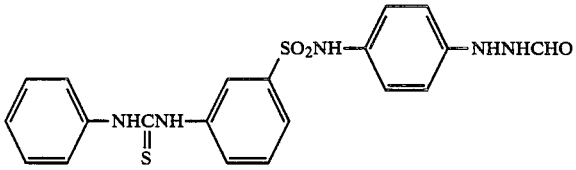
I-15
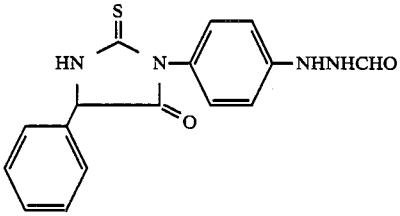
I-16
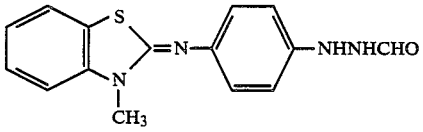
I-17
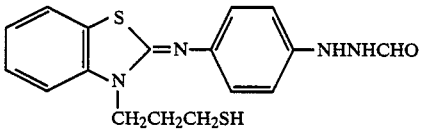
I-18
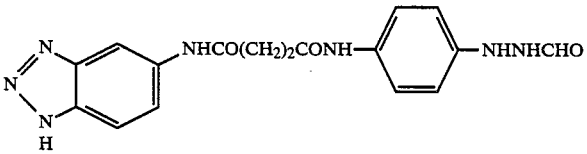
I-19
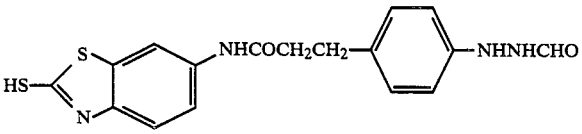
I-20
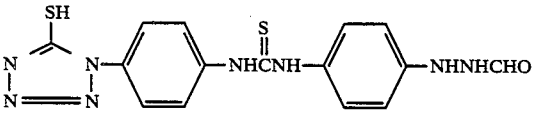
I-21
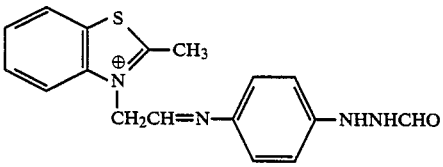
PTS⊖
I-22
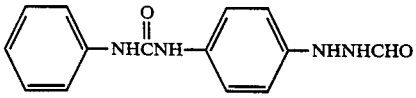

-continued
I-23
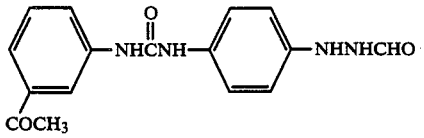
I-24
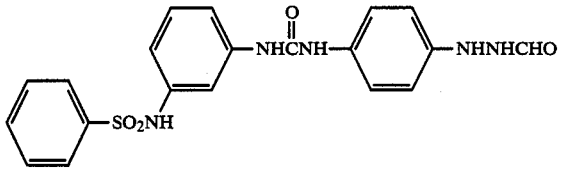
I-25
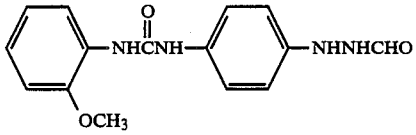
I-26
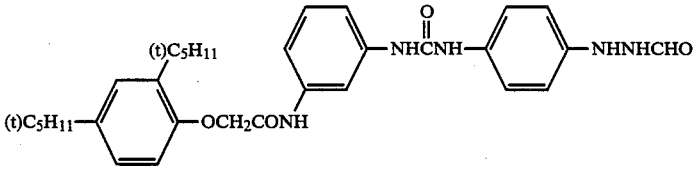
I-27
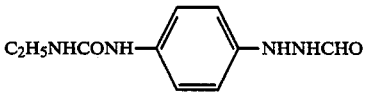
I-28
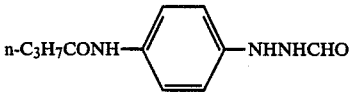
I-29
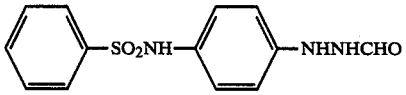
I-30
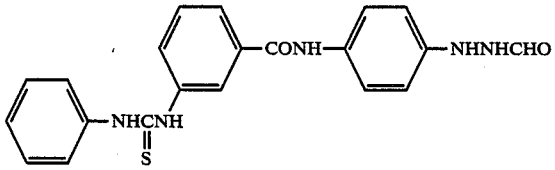
I-31
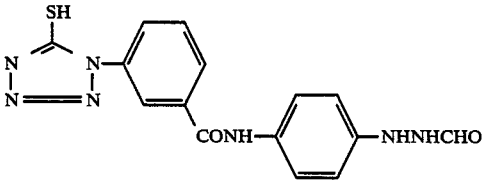
I-32
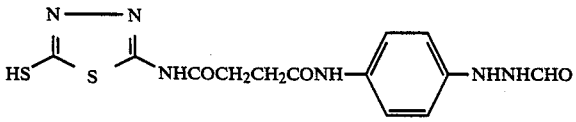

-continued
I-33
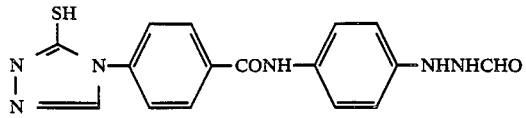
I-34
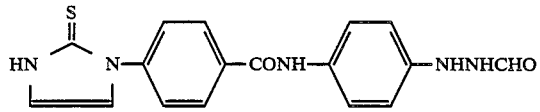
I-35
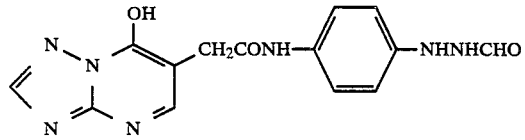
I-36
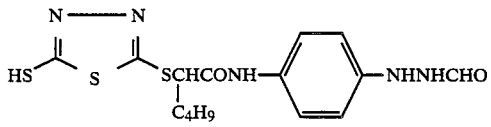
I-37
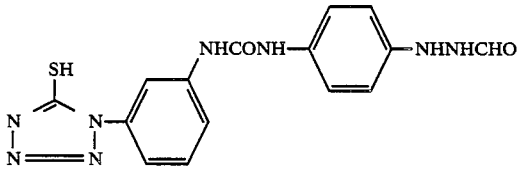
I-38
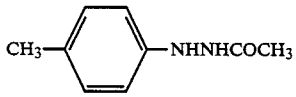
I-40
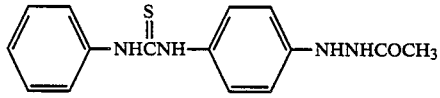
I-41
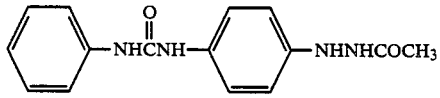
I-42
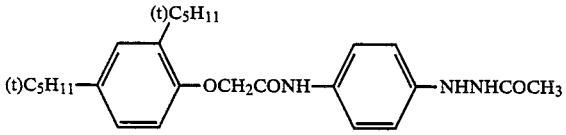
I-43
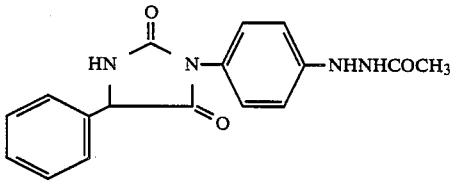
I-44
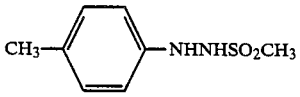
I-45
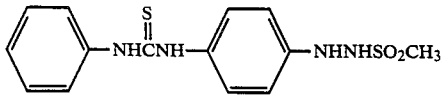

-continued
I-46
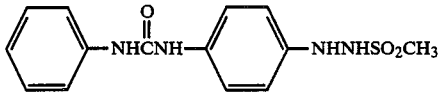
I-47
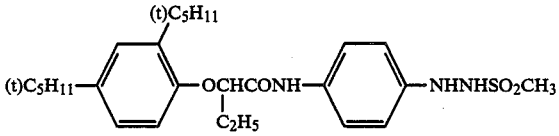
I-48
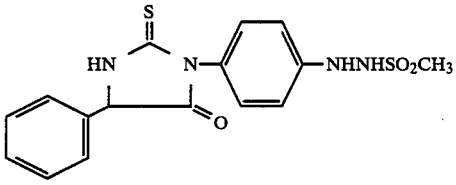
I-49
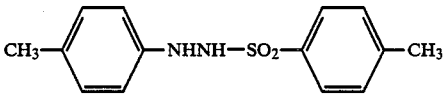
I-50
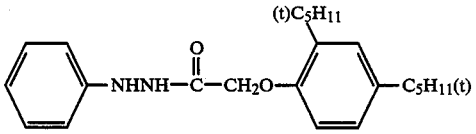
I-51
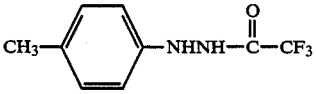
I-52
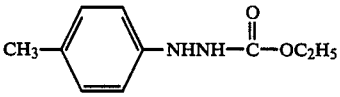
I-53
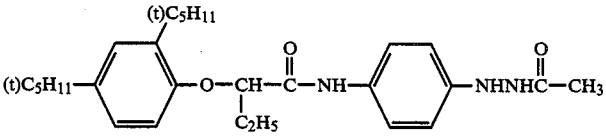
I-54
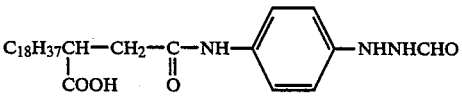
I-55
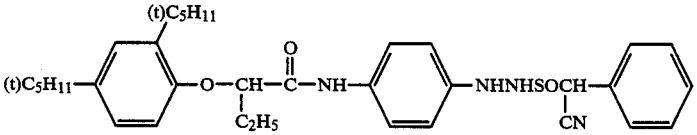
I-56
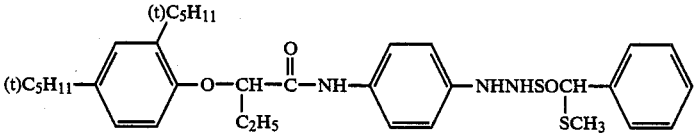
I-57
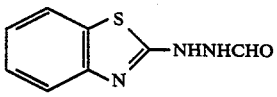

-continued

I-58

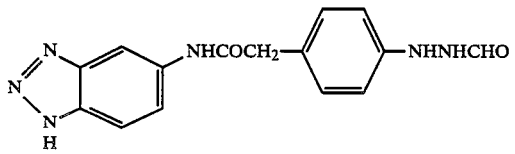

I-59 n-$C_{12}H_{25}$NHNHCHO

I-60

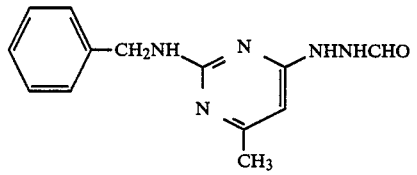

I-61

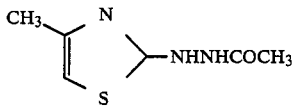

I-62

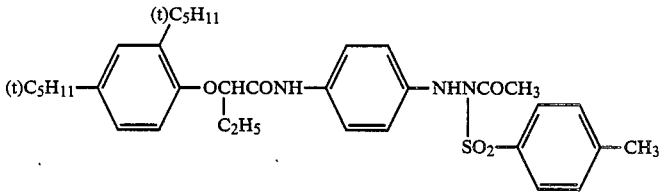

I-63

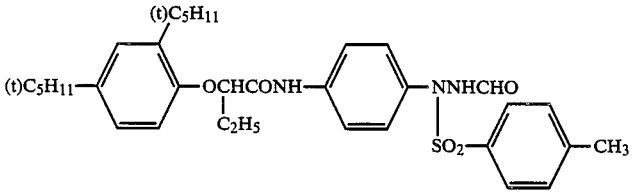

I-66

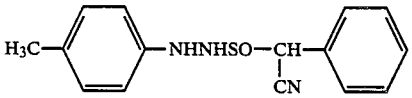

Processes for synthesizing these compounds of formula (I) are described, e.g., in Japanese patent application (OPI) Nos. 20921/78, 20922/78, 66732/78 and 20318/78, and U.S. Pat. Nos. 4,459,347 and 4,478,928.

In the above described formula (II), the unsaturated heterocyclic ring as represented by the partial structure

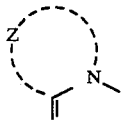

includes a pyrrole ring, a pyrazole ring, an imidazole ring, a triazole ring, a tetrazole ring, a pyridine ring, a pyridazine ring, a pyrimidine ring, a pyrazine ring, a triazine ring, an azepin ring, a diazepin ring, and hydrogen adducts thereof. The unsaturated heterocyclic ring may be condensed with an aryl group such as benzene and naphthalene.

The unsaturated heterocyclic ring and the aryl group with which to condense may be substituted with one or more appropriate substituents. Examples of the substituents are an alkyl group (preferably having from 1 to 20 carbon atoms, e.g., a methyl group, an ethyl group, a sec-octyl group, etc.); an aryl group (preferably having from 6 to 20 carbon atoms, e.g., a phenyl group, a naphthyl group, etc.); an alkoxy group (preferably having from 1 to 20 carbon atoms, e.g., a methoxy group, a hexadecyl group, etc.); an aryloxy group (preferably having from 6 to 20 carbon atoms, e.g., a phenoxy group, a naphthyloxy group, etc.); an alkylthio group (preferably having from 1 to 20 carbon atoms, e.g., a methylthio group, a dodecylthio group, etc.); an arylthio group (preferably having from 6 to 20 carbon atoms, e.g., a phenylthio group, etc.); a halogen atom (e.g., a chlorine atom, a fluorine atom, a bromine atom, an iodine atom, etc.); an acylamino group (preferably having from 1 to 20 carbon atoms (e.g., an acetamido group, a benzamido group, etc.); a sulfonamido group (preferably having from 1 to 20 carbon atoms, e.g., a methanesulfonamido group, a benzenesulfonamido group, etc); a ureido group (preferably having from 1 to 20 carbon atoms, e.g., a methylureido group, a hexylureido group, a phenylureido group, etc.); a cyano group; a carboxyl group; a carbamoyl group (preferably having from 1 to 20 carbon atoms, e.g., a carbamoyl group, an N-methylcarbamoyl group, an N-phenylcarbamoyl group, etc.); a sulfamoyl group (preferably having from 1 to 20 carbon atoms, e.g., a sulfamoyl group, an N-methylsulfamoyl group, an N-phenylsulfamoyl group, etc.); an acyloxy group (preferably having from 1 to 20 carbon atoms, e.g., an acetoxy group, a benzoxy group, etc.); an alkoxycarbonyl group (preferably having from 2 to 20 carbon atoms, e.g., a methoxycarbonyl group, a dodecyloxycarbonyl group, etc.); an aryloxycarbonyl group (preferably having from 7 to 20 carbon atoms, e.g., a phenoxycarbonyl group, etc.); an acyl group (preferably having from 1 to 20 carbon atoms, e.g., a formyl group, an acetyl group, a benzoyl group, etc.); an amino group (preferably having up to 20 carbon atoms, e.g., an amino group, an N-methylamino group, an N,N-dimethylamino group, an N-propylamino group, an N-phenylamino group, etc.); an imino group (preferably having up to 20 carbon atoms, e.g., an imino group, an N-methylimino group, an N-phenylimino group, etc.); a nitroso group; an alkenyl group (preferably having from 2 to 20 carbon atoms, e.g., an alkyl group, etc.); an alkynyl group (preferably having from 2 to 20 carbon atoms, e.g., a propargyl group, etc.); a sulfonyl group (preferably having from 1 to 20 carbon atoms, e.g., a methanesulfonyl group, a benzenesulfonyl group, etc.); a hydroxyl group; and the like. These substituents may further be substituted with the above enumerated substituents.

The unsaturated heterocyclic ring as represented by

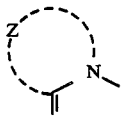

is preferably a 6-membered ring, and more preferably derived from a pyridine ring or a pyridazine ring. The most preferred unsaturated hetero cyclic ring is a pyridine ring or pyridazine ring to which a benzene ring is condensed.

R includes a hydrogen atom, $R^{21}$—, $R^{21}O$—, $R^{21}S$—,

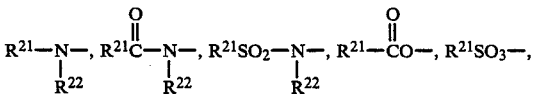

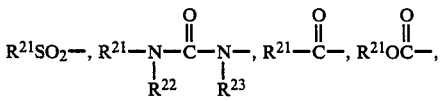

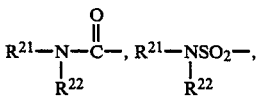

$R^{21}O_3S$—, —COOH, a halogen atom, —CN, etc., wherein $R^{21}$, $R^{22}$ and $R^{23}$, which may be the same or different, each represents a hydrogen atom, an aliphatic group or an aromatic ring.

The aliphatic group as represented by $R^{21}$, $R^{22}$, or $R^{23}$ includes a straight or branched chain alkyl group, an alkenyl group, an alkynyl group and a cycloalkyl group. The alkyl group contains from 1 to 18 carbons atoms and includes, for example, a methyl group, an ethyl group, a propyl group, a butyl group, a dodecyl group, an isopropyl group, a t-butyl group, a 2-ethylhexyl group, etc. The alkenyl group contains from 2 to 20 carbon atoms and includes an allyl group, a 2-butenyl group, etc. The alkynyl group contains from 2 to 20 carbon atoms and includes a propargyl group, a 2-butynyl group, etc. The cycloalkyl group contains from 3 to 12 carbon atoms and includes a cyclopropyl group, a cyclopentyl group, a cyclohexyl group, etc.

The aromatic group as represented by $R^{21}$, $R^{22}$ or $R^{23}$ contains from 6 to 20 carbon atoms and includes, for example, a phenyl group, a naphthyl group, etc.

These aliphatic or aromatic groups may be substituted with one or more appropriate substituents. The substituents are the same as enumerated for the unsaturated heterocyclic group

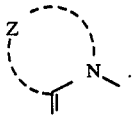

These substituents may be further substituted with the substituents selected from the same groups.

The halogen atom as represented by R includes a fluorine atom, a chlorine atom, a bromine atom and an iodine atom.

Specific but non-limiting examples of the compounds represented by formula (II) are set forth below.

II-1

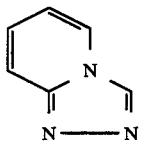

II-2

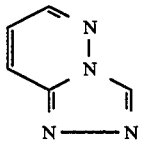

II-3

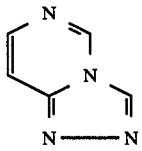

II-4

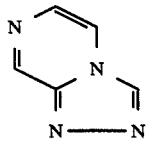

II-5

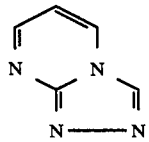

-continued
II-6
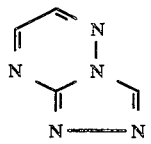
II-7
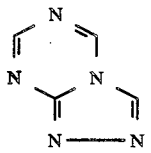
II-8
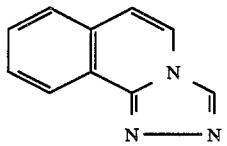
II-9
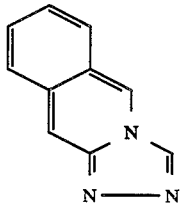
II-10
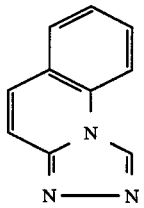
II-11
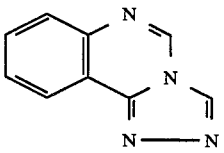
II-12
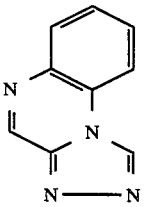
II-13
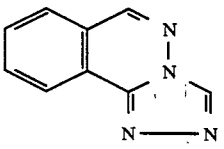
-continued
II-14
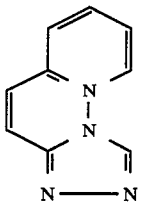
II-15
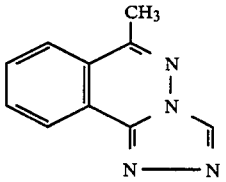
II-16
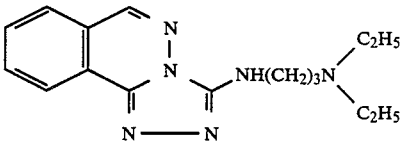
II-17
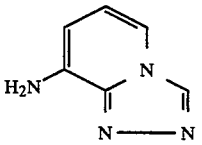
II-18
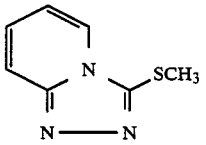
II-19
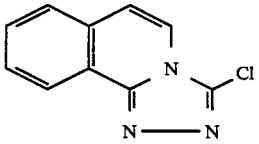
II-20
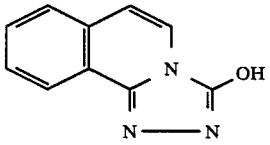
II-21
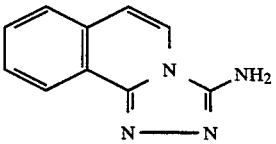
II-22
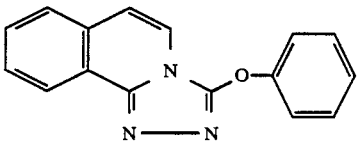

-continued

II-23

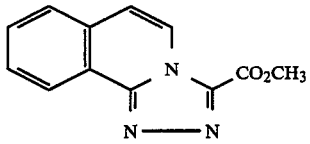

II-24

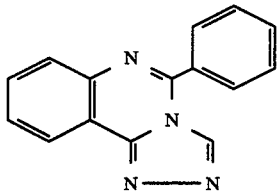

II-25

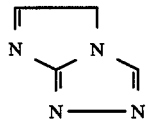

II-26

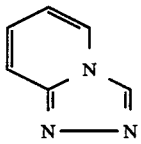

Some of the above recited specific compounds of formula (II) are available as commercial products. Other compounds of formula (II) can easily be synthesized with reference to the process described in A. R. Katritzky and C. W. Rees, *Comprehensive Heterocyclic Chemistry—The Structure, Reactions, Synthesis and Use of Heterocyclic Compounds,* Vol. 5, 847–904, Pergamon Press, Oxford (1984).

The compounds represented by formulae (I) and (II) may be incorporated in either a photographic light-sensitive material or a processing solution, e.g., a developer or its prebath. In the former case, they are preferably incorporated in a silver halide emulsion layer, but may also be incorporated in other light-insensitive hydrophilic colloidal layers, such as a protective layer, a filter layer, an antihalation layer, an interlayer, etc.

More specifically, the compounds of formulae (I) and (II) are added to a hydrophilic colloid solution or a processing solution in the form of an aqueous solution when being water-soluble or in the form of a solution in a water-miscible organic solvent, such as alcohols, esters, ketones, and the like, when being sparingly water-soluble. Addition to the silver halide emulsion layer may be effected at any stage from the start of chemical ripening through the stage before coating, preferably from the end of chemical ripening through the stage before coating, and more preferably immediately before coating.

The amount of the compound of formula (I) or (II) to be added is appropriately selected depending upon the grain size and halogen composition of a silver halide emulsion, the method and degree of chemical ripening, the relation between a layer to which the compound is added and a silver halide emulsion layer, the type of an antifoggant used, and the like. Such selection is well known in the art.

In the case of incorporating the compounds in a silver halide emulsion layer or other colloidal layers, the amount of the compound of formula (I) to be used preferably ranges from $10^{-6}$ to $10^{-1}$ mol, and more preferably from $10^{-5}$ to $4\times10^{-2}$ mol, per mol of silver halide, and the amount of the compound of formula (II) to be used preferably ranges from $10^{-5}$ to $2\times10^{-2}$ mol, and more preferably from $10^{-4}$ to $10^{-2}$ mol, per mol of silver halide.

When the compounds of formulae (I) and (II) are added to a processing solution, the amount of the compound of formula (I) to be added preferably ranges from $10^{-4}$ to $10^{-2}$ mol/liter, and more preferably from $5\times10^{-4}$ to $5\times10^{-3}$ mol/liter, and the amount of the compound of formula (II) to be added preferably ranges from $10^{-4}$ to $10^{-1}$ mol/liter, and more preferably from $10^{-3}$ to $5\times10^{-2}$ mol/liter.

Silver halide grains which can be used in the present invention include silver iodobromide, silver iodochlorobromide, silver bromide, and silver chlorobromide, with a silver bromide content being not less than 30 mol % and preferably not less than 70 mol %. The silver iodide content, if any, is generally from 0.01 to 10 ml %, and preferably from 0.1 to 5 mol %, as an average, throughout individual grains. A particularly preferred halogen composition is silver iodobromide having a silver iodide content of from 0.1 to 5 mol %.

The silver halide grains to be used in the present invention are preferably fine grains, e.g., as having a mean grain size of not more than 0.7 μm, and particularly not more than 0.5 μm. Grain size distribution is not essentially restricted, but a monodispersed silver halide emulsion having narrow grain size distribution is preferred. The term "monodispersed emulsion" herein used means an emulsion wherein at least 95% of the weight or number of total silver halide grains is included in the size range within ±40% of the mean grain size.

Silver halide grains in the photographic emulsion may have a regular crystal form, such as a cube, an octahedron, etc., or an irregular crystal form, such as a sphere, a plate, etc., or a composite form thereof.

The silver halide grains may have a homogeneous phase or a heterogeneous phase from the surface layer to the inside thereof. Two or more different silver halide emulsions separately prepared may be used as a mixture.

In the formation of silver halide grains or the subsequent physical ripening thereof, a cadmium salt, a sulfite, a lead salt, a thallium salt or a complex salt thereof may be present in the silver halide emulsion.

The silver halide emulsion which can be used in the present invention is preferably the one prepared in the presence of a rhodium salt or an iridium salt. In particular, it is desirable to add an iridium salt to the silver halide emulsion by the end of physical ripening, and preferably during the grain formation, in an amount of from $10^{-8}$ to $10^{-5}$ mol per mol of silver halide. The iridium salt which can be used includes water-soluble iridium salts or iridium complex salts, such as iridium trichloride, iridium tetrachloride, potassium hexachloroiridate (III), potassium hexachloroiridate (IV), ammonium hexachloroiridate (III), etc.

The silver halide emulsion prepared in the presence of iridium enjoys noticeable effects of the present invention when the silver halide grains have a larger silver iodide content in their surfaces than the silver iodide content averaged throughout the individual grains.

The terminology "surface of the grains" indicates a surface layer from the outer surface to a depth of from 100 Å 200 Å. In the present invention, it is particularly preferable that the silver iodide content in the surfaces of grains be at least 50% greater than the average throughout the grains.

Use of a rhodium salt or a complex salt thereof is favorable since such enhances suitability of the emulsion for rapid processing. Employable rhodium salts typically include rhodium chloride, rhodium trichloride, rhodium ammonium chloride, and the like. Complex salts of rhodium may also be used. Addition of the rhodium salt is effected before completion of the first ripening, and preferably during the grain formation. The amount to be added is in the range of from $10^{-8}$ mol to $8\times10^{-4}$ mol, and preferably from $10^{-7}$ to $5\times10^{-6}$ mol, per mol of silver halide. While addition of a rhodium salt to a silver halide emulsion generally brings about not only an increase in contrast but also reduction of sensitivity, the present invention is characterized in that the sensitivity can be restored and, at the same time, contrast can markedly be increased by the use of the compounds of formulae (I) and (II).

The photographic emulsion which can be used in the present invention can contain various compounds known as antifoggants or stabilizers for the purpose of preventing fog during the preparation, preservation or photographic processing of the light-sensitive materials or stabilizing photographic performances. Such compounds include azoles, e.g., benzothiazolium salts, nitroindazole, nitrobenzimidazoles, chlorobenzimidazoles, bromobenzimidazoles, mercaptothiazoles, mercaptobenzothiazoles, mercaptobenzimidazoles, mercaptothiazoles, aminotriazoles, benzotriazoles, nitrobenzotriazoles, mercaptotetrazoles (especially, 1-phenyl-5-mercaptotetrazole), etc.; mercaptopyrimidines; mercaptotriazines; thioketo compounds, e.g., oxazolinethione, etc.; azaindenes, e.g., triazaindenes, tetraazaindenes (especially, 4-hydroxy-substituted-(1,3,3*a*, 7)tetraazaindenes), pentaazaindenes, etc.; benzenethiosulfonic acid; benzenesulfinic acid; benzenesulfonic acid amide; and the like.

Particularly preferred among these compounds are benzotriazoles, e.g., 5-methylbenzotriazole, and nitroindazoles, e.g., 5-nitroindazole. These compounds may be incorporated into a processing solution.

The photographic emulsion layer or other hydrophilic colloidal layers of the photographic light-sensitive materials of this invention can contain organic or inorganic hardeners, such as chromium salts, e.g., chromium alum, chromium acetate, etc.; aldehydes, e.g., formaldehyde, glyoxal, glutaraldehyde, etc.; N-methylol compounds, e.g., dimethylolurea, methyloldimethylhydantoin, etc.; dioxane derivatives, e.g., 2,3-dihydroxydioxane, etc.; active vinyl compounds, e.g., 1,3,5-triacryloyl-hexahydro-s-triazine, 1,3-vinylsulfonyl-2-propanol, etc.; active halogen compounds, e.g., 2,4-dichloro-6-hydroxy-s-triazine, etc.; mucohalogenic acids, e.g., mucochloric acid, mucophenoxychloric acid, etc.; and the like, either alone or in combination thereof.

The photographic emulsion layer or other hydrophilic colloidal layers of the light-sensitive materials of this invention can further contain a wide variety of surface active agents for various purposes, for example, for coating aid, prevention of static charge, improvement of slipperiness, emulsification aid, prevention of adhesion, improvement of photographic characteristics, such as development acceleration and increase in contrast and sensitivity, and the like.

Examples of the surface active agents to be used include nonionic surface active agents, such as saponin (steroid type), alkylene oxide derivatives, e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone, etc., glycidol derivatives, e.g., alkenylsuccinic polyglycerides, alkylphenyl polyglycerides, etc., fatty acid esters of polyhydric alcohols, alkyl esters of sugars, and the like; anionic surface active agents containing acidic group, e.g., a carboxyl group, a sulfo group, a phospho group, a sulfuric ester group, a phosphoric ester group, etc., such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Of these, polyalkylene oxides having a molecular weight of 600 or more, as described in Japanese Pat. Publication No. 9412/83, are preferably used in the present invention.

The photographic emulsion layer and other hydrophilic colloidal layers may furthermore contain a dispersion of a water-insoluble or sparingly water-soluble polymer for the purpose of improving dimensional stability, and the like. Examples of such a polymer are polymers comprising a monomer or monomers selected from alkyl (meth)acrylates, alkoxyalkyl (meth)acrylates, glycidyl (meth)acrylates, (meth)acrylamides, vinyl esters (e.g., vinyl acetate), acrylonitrile, olefins, styrene, and so on; and polymers comprising a monomer or monomers selected from the above described compounds and a monomer or monomers selected from acrylic acid, methacrylic acid, $\alpha,\beta$-unsaturated dicarboxylic acids, hydroxyalkyl (meth)acrylates, sulfoalkyl (meth)acrylate, styrenesulfonic acid, and so on.

According to the present invention, the silver halide photographic materials can be developed with a stable developer to obtain excellent photographic properties of superhigh contrast and high sensitivity, and use of a conventional infectious developer or a highly alkaline developer of pH near 13 as described in U.S. Pat. No. 2,419,975 is no more necessary. That is, a negative image having a sufficiently high contrast can be obtained by developing the silver halide photographic materials of the present invention with a developer containing not less than 0.15 mol/liter of a sulfite ion and having a pH of from 10.5 to 12.3, and preferably from 11.0 to 12.0.

Developing agents which can be used in the present invention are not particularly limited, and dihydroxybenzenes (e.g., hydroquinone), 3-pyrazolidones (e.g., 1-phenyl-3-pyrazolidone, 4,4-dimethyl-1-phenyl-3-pyrazolidone), aminophenols (e.g., N-methyl-p-aminophenol), and the like can be used, either alone or in combinations thereof.

The silver halide photographic materials according to the present invention are particularly suitable for processing with a developer containing dihydroxybenzenes as developing agent and 3-pyrazolidones or aminophenols as an auxiliary developing agent. This type of a developer preferably contains from 0.05 to 0.5 mol/liter of a dihydroxybenzene and 0.06 mol/liter or less of a 3-pyrazolidone or aminophenol.

The developer can further contain a pH buffer, such as sulfites, carbonates, borates, and phosphates of alkali metals, a development restrainer or antifoggant, such as bromides, iodides and organic antifoggants (particularly, nitroindazoles and benzotriazoles), and other conventional developer additives. For instance, if desired, the developer can furthermore contain a water softener, a dissolution aid, a toning agent, a development accelerator, a surface active agent (preferably, the above described polyalkylene oxides), a defoaming agent, a hardener, a silver stain inhibitor (e.g., 2-mercaptobenzimidazolesulfonic acids), and the like.

Specific examples of these additives are described in *Research Disclosure,* RD No. 17643 (Dec., 1978), etc.

A conventional fixing solution can be used. Examples of fixing agents to be used include not only thiosulfates and thiocyanates, but also organic sulfur compounds known to have a fixing effect. The fixing solution may contain a water-soluble aluminum salts as a hardener.

The processing temperature is usually selected from 18° to 50° C., but temperatures lower than 18° C., or higher than 50° C. may also be employed.

Photographic processing is preferably carried out by the use of an automatic developing machine.

According to the present invention, satisfactory photographic characteristics, i.e., superhigh contrast, high sensitivity, and negative gradation, can be obtained even when the total processing time of the automatic developing machine from the time of entrance through the time of exit of the photographic material being set at from 90 to 120 seconds.

According to the present invention, photographic properties effective for reproduction of dot images or line images, i.e., high sensitivity and superhigh contrast, can be assured even with a stable developer by the use of the compound of formula (I) and the compound of formula (II).

Preferred embodiments according to the present invention are set forth below:

(1) A silver halide photographic material containing the compound of formula (I) and the compound of formula (II).

(2) A process for forming a superhigh contrast image comprising developing the photographic material of Embodiment (1) with a developer containing not less than 0.15 mol/liter of a sulfite ion and having a pH of from 10.5 to 12.3.

(3) A silver halide photographic material as in Embodiment (1) or an image formation process as in Embodiment (2), wherein a silver halide emulsion of the photographic material comprises surface latent image type silver halide grains prepared in the presence of from $10^{-8}$ to $8\times10^{-4}$ mol of a rhodium salt per mol of silver halide.

(4) A silver halide photographic material as in Embodiment (1) or an image formation process as in Embodiment (2), wherein a silver halide emulsion of the photographic material comprises silver halide grains prepared in the presence of from $10^{-8}$ to $10^{-5}$ mol of an iridium salt per mol of silver halide.

The present invention will now be illustrated in greater detail with reference to the following examples, but it is to be understood that these examples do not limit the present invention. In these examples, all the percents are by weight unless otherwise indicated.

EXAMPLE 1

A silver chlorobromide emulsion containing rhodium and having a mean grain size of 0.3 μm was prepared. After soluble salts were removed from the emulsion in a usual manner, the emulsion was chemically ripened with sodium thiosulfate and potassium chloroaurate. The resulting emulsion comprised 70 mol % of silver chloride and 30 mol % of silver bromide and contained $8\times10^{-6}$ mol of rhodium per mol of silver.

The silver chlorobromide emulsion was divided into 8 portions, and the compound or compounds of the present invention was or were added to each portion as shown in Table 1. Then, potassium 4-[5-chloro-2-{2-[1-(5-hydroxy-3-oxapentyl)-3-(2-pyridyl-2-thiohydantoin-5-ylidene]ethylidene}-3-benzoxazolio]butanesulfonate was added thereto as a sensitizing dye. 5-Methylbenzotriazole, 4-hydroxy-6-methyl-1,3,3*a*, 7-tetraazaindene, a dispersion of polyethyl acrylate and 2-hydroxy-4,6-dichloro-1,3,5-triazine sodium salt were further added to each mixture. The resulting coating composition was coated on a cellulose acetate film to a silver coverage of 4 g/m$^2$ and dried.

The resulting light-sensitive material was exposed to light through an optical wedge for sensitometry, and the exposed film was developed with Developer (I) having the following composition at 38° C. for 20 seconds, stopped, fixed, washed with water and dried.

| Composition of Developer (I): | |
|---|---|
| Hydroquinone | 40.0 g |
| 4,4-Dimethyl-1-phenyl-3-pyrazolidone | 0.4 g |
| Anhydrous Sodium Sulfite | 75.0 g |
| Sodium Hydrogencarbonate | 7.0 g |
| Sodium Ethylenediaminetetraacetate | 1.0 g |
| Potassium Bromide | 6.0 g |
| 5-Methylbenzotriazole | 0.69 g |
| Water to make | 1 liter |
| Potassium hydroxide to adjust to a pH of 11.8 | |

The thus processed light-sensitive material was determined for sensitivity, gamma and dot quality according to the following methods, and the results obtained are shown in Table 1.

Sensitivity:

Sensitivity is expressed as a relative value of a reciprocal of an exposure providing a density of 1.5, taking the sensitivities of Sample Nos. 1 and 4 as 100, with respect to Sample Nos. 2 and 3 and Sample Nos. 5 to 8, respectively.

Gamma:

Gamma is a tan $\theta$ made by a straight line connecting two points of optical densities 0.3 and 3.0.

Dot Quality:

Dot quality is visually evaluated and graded 1 to 5. The grade "5" indicates the best quality, and the grade "1" indicates the worst. Dots graded "5" or "4" are of practical use; dots graded "3" are the practically usable lowest limit; and dots graded "2" or "1" are of no practical use.

TABLE 1

| Sample No. | Compound of Formula (I) Kind | Amount ($\times 10^{-4}$ mol/mol Ag) | Compound of Formula (II) Kind | Amount ($\times 10^{-4}$ mol/mol Ag) | Relative Sensitivity | Gamma | Dot Quality |
|---|---|---|---|---|---|---|---|
| 1 | I-25 | 4.0 | — | — | 100 (standard) | 9.5 | 3 |
| 2 | " | " | II-13 | 20 | 96 | 12.7 | 4 |
| 3 | " | " | " | 50 | 102 | 14.0 | 5 |
| 4 | I-9 | 40.0 | — | — | 100 (standard) | 8.3 | 3 |
| 5 | " | " | II-8 | 20 | 105 | 15.0 | 4 |
| 6 | " | " | " | 50 | 112 | 14.5 | 4 |
| 7 | " | " | II-13 | 20 | 110 | 13.9 | 4 |
| 8 | " | " | " | 50 | 120 | 12.8 | 4 |

As is apparent from Table 1, the presence of the compound of formula (II) in the light-sensitive materials improves sensitivity, gamma and dot quality over those obtained in the presence of the compound of formula (I) alone.

EXAMPLE 2

An aqueous silver nitrate solution and a mixture of an aqueous potassium iodide solution and an aqueous potassium bromide solution were simultaneously added to an aqueous gelatin solution kept at 50° C. in the presence of $5\times10^{-7}$ mol of potassium hexachloroiridate (III) per mol of silver over a period of 60 minutes while maintaining the pAg at 7.5 There was obtained a monodispersed silver iodobromide emulsion having a silver iodide content of 1 mol % and a mean grain size of 0.26 μm.

The resulting emulsion was washed with water in a usual manner to remove soluble salts. The emulsion was divided in 16 portions, and to each of which were added 5,5'-dichloro-9-ethyl-3,3'-disulfopropyloxacarbocyanine sodium salt as a sensitizing dye, 4-hydroxy-6-methyl-1,3,3*a*,7-tetraazaindene, a polyethyl acrylate dispersion, polyethylene glycol (molecular weight: 1,000) and 1,3-vinylsulfonyl-2-propanol. Then, the compound of the present invention was or were added thereto as shown in Table 2 below, and the resulting coating composition was coated on a polyethylene terephthalate film to a silver coverage of 4 g/m$^2$.

The resulting film was exposed to light through an optical wedge for sensitometry, and the exposed sample was developed with Developer (II) having the following composition at 38° C. for 30 seconds, stopped, fixed, washed with water and dried.

| Composition of Developer (II): | |
|---|---|
| Hydroquinone | 40.0 g |
| 4,4-Dimethyl-1-phenyl-3-pyrazolidone | 0.4 g |
| Sodium Hydroxide | 13.0 g |
| Anhydrous Potassium Sulfite | 90.0 g |
| Potassium Tertiary Phosphate | 74.0 g |
| Disodium Ethylenediaminetetraacetate | 1.0 g |
| Potassium Bromide | 6.0 g |
| 5-Methylbenzotriazole | 0.6 g |
| 1-Diethylamino-2,3-dihydroxypropane | 17.0 g |
| Wate to make | 1 liter |
| Potassium hydroxide to adjust to pH 11.5 | |

Relative sensitivity, gamma and dot quality of the samples were determined in the same manner as in Example 1, and the results obtained are shown in Table 2 below.

TABLE 2

| Sample No. | Compound of Formula (I) Kind | Amount ($\times 10^{-4}$ mol/mol Ag) | Compound of Formula (II) Kind | Amount ($\times 10^{-4}$ mol/mol Ag) | Relative Sensitivity | Gamma | Dot Quality |
|---|---|---|---|---|---|---|---|
| 11 | I-25 | 5.0 | — | — | 100 (standard) | 10.8 | 3 |
| 12 | " | 1.25 | — | — | 52 | 5.2 | 1 |
| 13 | " | " | II-8 | 10.0 | 123 | 14.3 | 4 |
| 14 | " | " | " | 20.0 | 145 | 18.0 | 5 |
| 15 | " | " | II-13 | 40.0 | 148 | 17.5 | 5 |
| 16 | I-9 | 20.0 | — | — | 100 (standard) | 7.9 | 1 |
| 17 | " | " | II-8 | 20.0 | 145 | 10.8 | 3 |
| 18 | " | " | " | 40.0 | 151 | 12.4 | 5 |
| 19 | " | " | II-13 | 20.0 | 115 | 11.2 | 4 |
| 20 | " | " | " | 40.0 | 126 | 10.6 | 4 |
| 21 | " | " | II-1 | 20.0 | 112 | 10.8 | 3 |
| 22 | " | " | " | 40.0 | 110 | 10.8 | 4 |
| 23 | I-5 | 12 | — | — | 100 (standard) | 9.5 | 3 |
| 24 | " | " | II-8 | 5 | 135 | 19.0 | 5 |
| 25 | " | " | " | 10 | 135 | 20< | 5 |
| 26 | " | " | " | 20 | 138 | 20< | 4 |

EXAMPLE 3

Sample Nos. 12 to 16, 18, 20 and 22 to 26 of Example 2 were processed in the same manner as in Example 2 but changing the development time to 20 seconds. The results obtained are shown in Table 3 below. In Table 3, the relative sensitivity was expressed taking the sensitivity of Sample Nos. 11, 16 and 23 when developed for 30 seconds as 100.

It can be seen from Table 3 that development of the light-sensitive materials containing both the compound of formula (I) and the compound of formula (II) for 20 seconds can provide higher contrast than development of the samples containing the compound of formula (I) alone for 30 seconds.

TABLE 3

| Sample No. | Compound of Formula (I) Kind | Amount ($\times 10^{-4}$ mol/mol Ag) | Compound of Formula (II) Kind | Amount ($\times 10^{-4}$ mol/mol Ag) | Relative Sensitivity | Gamma | Dot Quality |
|---|---|---|---|---|---|---|---|
| 12 | I-25 | 1.25 | — | — | 48 | 4.5 | 1 |
| 13 | " | " | II-8 | 10 | 123 | 13.9 | 4 |
| 14 | " | " | " | 20 | 132 | 13.9 | 4 |
| 15 | " | " | II-13 | 40 | 137 | 13.9 | 4 |
| 16 | I-9 | 20.0 | — | — | 89 | 5.5 | 1 |
| 18 | " | " | II-8 | 40 | 138 | 12.0 | 4 |
| 20 | " | " | II-13 | 40 | 112 | 10.5 | 4 |
| 22 | " | " | II-1 | 40 | 93 | 10.2 | 4 |
| 23 | I-5 | 12 | — | — | 89 | 9.5 | 3 |
| 24 | " | " | II-8 | 5 | 110 | 15.0 | 5 |
| 25 | " | " | " | 10 | 112 | 20< | 5 |
| 26 | Δ | " | " | 20 | 117 | 18.5 | 5 |

EXAMPLE 4

A silver iodobromide emulsion was prepared in the same manner as described in Example 2.

The emulsion was divided in 8 portions, and to each of which were added 5,5'-dichloro-9-ethyl-3,3'-disulfopropyloxacarbocyanine sodium salt as a sensitizing dye, 4-hydroxy-6-methyl-1,3,3*a*,7-tetraazaindene, a polyethyl acrylate dispersion, polyethylene glycol (molecular weight: 1,000) and 1,3-vinylsulfonyl-2-propanol. Then, the compound of formula (I) of the present invention was added thereto as shown in Table 4. The resulting coating composition was coated on a polyethylene terephthalate film and dried.

The resulting light-sensitive material was exposed to light through an optical wedge for sensitometry, and the exposed film was developed with Developer (I) as used in Example 1 to which the compound of formula (II) of the present invention had been added, as shown in Table 4, at 38° C. for 30 seconds, stopped, fixed, washed with water, and dried.

Sensitivity, gamma, and dot quality were determined in the same manner as in Example 1, and the results obtained are shown in Table 4.

The results of Table 4 prove that these photographic properties can be improved by incorporating the compound of formula (II) into a developer.

TABLE 4

| Sample No. | Compound of Formula (I) in Emulsion Kind | Amount ($\times 10^{-4}$ mol/mol Ag) | Compound of Formula (II) in Developer Kind | Amount ($\times 10^{-4}$ mol/mol liter) | Relative Sensitivity | Gamma | Dot Quality |
|---|---|---|---|---|---|---|---|
| 31 | I-25 | 7.5 | — | — | 100 (standard) | 3.7 | 1 |
| 32 | " | " | II-8 | 5.0 | 220 | 9.2 | 3 |
| 33 | " | " | " | 10.0 | 310 | 11.5 | 4 |
| 34 | " | " | " | 20.0 | 350 | 14.5 | 4 |
| 35 | I-9 | 40.0 | — | — | 100 (standard) | 3.3 | 1 |
| 36 | " | " | II-8 | 5.0 | 220 | 9.5 | 4 |
| 37 | " | " | " | 10.0 | 282 | 11.5 | 4 |
| 38 | " | " | " | 20.0 | 263 | 15.0 | 5 |

EXAMPLE 5

Light-sensitive materials were produced in the same manner as described in Example 1, but using neither the compound of formula (I) nor the compound of formula (II).

Each of the films was exposed to light and processed in the same manner as in Example 1, except for using Developer (I) to which the compound of formula (I) alone or both the compound of formula (I) and the compound of formula (II) had been added as shown in Table 5.

It can be seen from Table 5 that sensitivity, gamma, and dot quality can be improved by the presence of the compound of formula (I) and the compound of formula (II) in the developer.

TABLE 5

| Sample No. | Compound of Formula (I) Kind | Amount ($\times 10^{-3}$ mol/liter) | Compound of Formula (II) Kind | Amount ($\times 10^{-3}$ mol/liter) | Relative Sensitivity | Gamma | Dot Quality |
|---|---|---|---|---|---|---|---|
| 41 | I-2 | 1.3 | — | — | 100 | 9.5 | 2 |
| 42 | " | " | II-8 | 2 | 105 | 11.0 | 3 |
| 43 | " | " | " | 5 | 190 | 12.3 | 4 |
| 44 | " | " | " | 10 | 200 | 14.9 | 5 |
| 45 | " | " | " | 20 | 310 | 13.0 | 4 |
| 46 | " | " | II-13 | 10 | 185 | 11.5 | 4 |
| 47 | " | " | " | 20 | 210 | 13.3 | 4 |

While the invention has been described in detail and with reference to specific embodiments thereof, it will be apparent to one skilled in the art that various changes and modifications can be made therein without departing from the spirit and scope thereof.

What is claimed is:

1. A process for forming a superhigh contrast negative image comprising development processing a photographic light-sensitive material comprising a support having provided thereon at least one silver halide emulsion layer with a developer containing not less than 0.5 mol/liter of a sulfite ion and having a pH of from 10.5 to 12.3, wherein the development processing is carried out in the presence on a compound represented by formula (I)

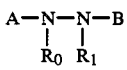

(I)

wherein A represents an aliphatic group or an aromatic group; B represents a formyl group, an acyl group, an alkyl sulfonyl group, an arylsulfonyl group, an alkyl sulfinyl group, an arylsulfinyl group, a carbamoyl group, a sulfamoyl group, an alkoxycarbonyl group, an aryloxycarbonyl group, a sulfinamoyl group, an alkoxysulfonyl group, a thioacyl group, a thiocarbamoyl group, or a heterocyclic group; $R_0$ and $R_1$ each represent a substituent selected from the group consisting of a hydrogen atom, a substituted or unsubstituted alkylsulfonyl group and a substituted or unsubstituted acyl group, provided that at least one of $R_0$ and $R_1$ is a hydrogen atom; or B, $R_1$, and the nitrogen atom to which B and $R_1$ are bonded jointly form the group

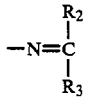

wherein $R_2$ represents a substituent selected from the group consisting of an alkyl group, an aryl group, and a heterocyclic group, and $R_3$ represents a substituent selected from the group consisting of a hydrogen atom, an alkyl group, an aryl group, and a heterocyclic group; and a compound represented by formula (II)

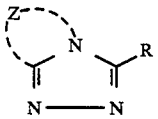

(II)

wherein Z represents an atomic group comprising atoms selected from carbon atoms and nitrogen atoms forming a 5- to 7-membered unsaturated heterocyclic or condensed heterocyclic ring, wherein said condensed heterocyclic ring is condensed with a monocyclic or dicyclic aryl group and wherein said atomic group is unsubstituted or substituted by a group selected from the group consisting of an alkyl, aryl, alkoxy, aryloxy, alkylthio, arylthio, halogen, acylamino, sulfonamido, ureido, cyano, carboxyl, carbamoyl, sulfamoyl, acyloxy, alkoxycarbonyl, aryloxycarbonyl, acyl, amino, imino, nitroso, alkynyl and sulfonyl groups and wherein said unsaturated condensed heterocyclic ring is condensed with a monocyclic or dicyclic aryl group; and R represents one substituent selected from the group consisting of

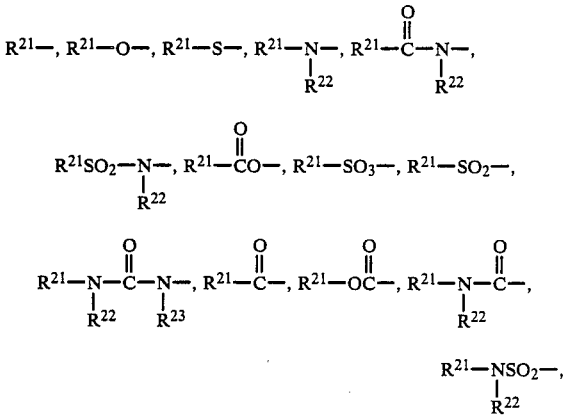

[$R^{21}OO_3S$—] $R^{21}O_3S$—, —COOH, a halogen atom, and —CN, wherein $R^{21}$, $R^{22}$ and $R^{23}$ are each selected from the group consisting of a hydrogen atom, an aliphatic group or an aromatic group.

2. A process as in claim 1, wherein A in formula (I) represents a substituted or unsubstituted aryl group.

3. A process as in claim 1, wherein B in formula (I) represents a formyl group or an acyl group.

4. A process as in claim 1, wherein $R_0$ and $R_1$ in formula (I) each represents a hydrogen atom.

5. A process as in claim 1, wherein the unsaturated heterocyclic group represented by

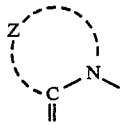

in formula (II) is a pyridine ring or pyridazine ring with which a benzene ring is condensed.

6. A process as in claim 1, wherein said compound represented by formula (I) and compound represented by formula (II) are present in the photographic light-sensitive material.

7. A process as in claim 6, wherein said compound represented by formula (I) and compound represented by formula (II) are present in the silver halide emulsion layer.

8. A process as in claim 6, wherein said compound represented by formula (I) is present in an amount of from $1\times10^{-6}$ to $1\times10^{-1}$ mol per mol of silver halide and said compound represented by formula (II) is present in an amount of from $1\times10^{-5}$ to $2\times10^{-2}$ mol per mol of silver halide.

9. A process as in claim 8, wherein said compound represented by formula (I) is present in an amount of from $1\times10^{-5}$ to $4\times2$ mol per mol of silver halide and said compound represented by formula (II) is present in an amount of from $1\times10^{-4}$ to $1\times10^{-2}$ mol per mol of silver halide.

10. A process as in claim 1, wherein said compound represented by formula (I) and compound represented by formula (II) are present in a developer.

11. A process as in claim 10, wherein said compound represented by formula (I) is present in an amount of from $1\times10^{-4}$ to $1\times10^{-2}$ mol/liter and said compound represented by formula (II) is present in an amount of from $1\times10^{-4}$ to $1\times10^{-1}$ mol/liter.

12. A process as in claim 11, wherein said compound represented by formula (I) is present in an amount of from $5\times10^{-4}$ to $5\times3$ mol/liter and said compound represented by formula (II) is present in an amount of from $1\times10^{-3}$ to $5\times10^{-2}$ mol/liter.

13. A process as in claim 1, wherein said silver halide emulsion is prepared in the presence of from $1\times8$ to $8\times10^{-4}$ mol of a rhodium salt per mol of silver halide.

14. A process as in claim 1, wherein said silver halide emulsion is prepared in the presence of from $1\times10^{-8}$ to $1\times10^{-5}$ mol of an iridium salt per mol of silver halide.

15. A photographic light-sensitive material comprising a support having provided thereon at least one silver halide emulsion layer, which contains a compound represented by formula (I)

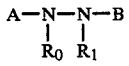

(I)

wherein A represents an aliphatic group or an aromatic group; B represents a formyl group, an acyl group, an alkylsulfonyl group, an arylsulfonyl group, an alkyl-sulfinyl group, an arylsulfinyl group, a carbamoyl group, a sulfamoyl group, an alkoxycarbonyl group, an aryloxycarbonyl group, a sulfinamoyl group, an alkoxysulfonyl group, a thioacyl group, a thiocarbamoyl group, or a heterocyclic group; $R_0$ and $R_1$ each represent a substituent selected from the group consisting of a hydrogen atom, a substituted or unsubstituted alkylsulfonyl group, a substituted or unsubstituted arylsulfonyl group and a substituted or unsubstituted acyl group, provided that at least one of $R_0$ and $R_1$ is a hydrogen atom; or B, $R_1$, and the nitrogen atom to which B and $R_1$ are bonded jointly form the group

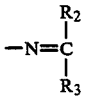

wherein $R_2$ represents a substituent selected from the group consisting of an alkyl group, an aryl group, and a heterocyclic group, and $R_3$ represents a substituent selected from the group consisting of a hydrogen atom, an alkyl group, an aryl group, and a heterocyclic group; and a compound represented by formula (II)

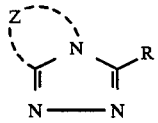

(II)

wherein Z represents an atomic group comprising atoms selected from carbon atoms and nitrogen atoms forming a 5- to 7-membered unsaturated heterocyclic or condensed heterocyclic ring wherein said condensed heterocyclic ring is condensed with a monocyclic or dicyclic aryl group and wherein said atomic group is unsubstituted or substituted by a group selected from the group consisting of alkyl, aryl, alkoxy, aryloxy, alkylthio, arylthio, halogen, acylamino, sulfonamido, ureido, cyano, carboxyl, carbamoyl, sulfamoyl, acyloxy, alkoxycarbonyl, aryloxycarbonyl, acyl, amino, imino, nitroso, alkynyl and sulfonyl groups and R represents one substituent selected from the group consisting of

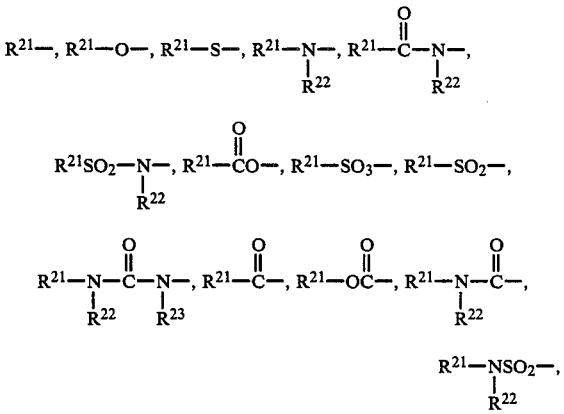

$R^{21}O_3S$—, —COOH, a halogen atom, and —CN, wherein $R^{21}$, $R^{22}$ and $R^{23}$ are each selected from the group consisting of a hydrogen atom, an aliphatic group or an aromatic group.

* * * * *